US006237651B1

(12) United States Patent
Fuin et al.

(10) Patent No.: US 6,237,651 B1
(45) Date of Patent: May 29, 2001

(54) MACHINE AND METHOD FOR FILLING CONTAINERS, IN PARTICULAR BOTTLES

(75) Inventors: Renato Fuin, Albaredo d'Adige-Verona; Claudio Saurin, Rubano-Padova, both of (IT)

(73) Assignee: Gruppo Bertolaso S.p.A., Verona (IT)

( * ) Notice: Subject to any disclaimer, the term of this patent is extended or adjusted under 35 U.S.C. 154(b) by 0 days.

(21) Appl. No.: 09/462,473

(22) PCT Filed: Apr. 24, 1998

(86) PCT No.: PCT/EP98/02468

§ 371 Date: Jan. 14, 2000

§ 102(e) Date: Jan. 14, 2000

(87) PCT Pub. No.: WO99/03774

PCT Pub. Date: Jan. 28, 1999

(30) Foreign Application Priority Data

Jul. 14, 1997 (IT) ..... MI97A1668

(51) Int. Cl.[7] ..... B65B 1/04

(52) U.S. Cl. ..... 141/250; 141/59; 141/45

(58) Field of Search ..... 141/250, 263, 141/270, 271, 281, 283, 37, 39, 44, 45, 47, 48, 49, 50, 1, 2, 18, 59

(56) References Cited

U.S. PATENT DOCUMENTS 4,492,259 * 1/1985 Sick et al. ..... 141/198

* cited by examiner

*Primary Examiner*—Steven O. Douglas
(74) *Attorney, Agent, or Firm*—Oblon, Spivak, McClelland, Maier & Neustadt, P.C.

(57) ABSTRACT

A machine for the filling of containers, and in particular for the fillings of bottles, which combines advantages of a traditional isobaric machine with those of a machine operating under a slight depression, such as a good seal at a neck of a bottle and a minimum absorption of air by an introduced liquid. The machine allows performing steps of pre-evacuating air inside the bottle and insufflating an inert gas through the neck of the bottle.

15 Claims, 14 Drawing Sheets

MACHINE AND METHOD FOR FILLING CONTAINERS, IN PARTICULAR BOTTLES

BACKGROUND OF THE INVENTION

1. Field of the Invention

This invention relates to a machine for the filling of containers, in particular for the filling of bottles and to the relative filling method.

2. Discussion of the Background

The bottling and the packaging industry in general performs a series of successive operations for the purpose of filling containers such as bottles, vials, and cans with foodstuffs, cosmetics, chemical and pharmaceutical products, oils and paints, glues, detergents and other materials.

In particular, the foodstuffs and wine industry usually include the preliminary washing, rinsing and sanitizing operations for the bottles to be filled.

Then, the filling operation may be performed in different ways, depending on the products destined to fill the containers; for the filling of gaseous and sparkling wines, for example, the filling machines in use are of a so-called isobaric type, because the pressure of the container is the same as that of the storage tank holding the wine to be filled. A balanced pressure is therefore established between the holding container and the bottles, while evacuating the inside air to the outside. A first phase is therefore performed by pre-evacuating the air contained in the bottles while aspirating the same with a vacuum pump from a small tube placed next to the neck of each bottle.

EP-A-597161, for example, dislcoses a known filling machine of the isobaric type according to the preamble of the invention.

Said known machine essentially consists of a horizontal cylindrical container, whose lower section mounts a series of particular filling taps. The wine level in the tank is regulated by a float which governs, as the level changes, the opening and closing of a vent opposite to the inert gas chamber above the wine, resulting in a constant liquid level.

The filling taps are generally composed of a spout with two concentric tubes, one originating in the lower section of the tank draining the wine to the bottle and one leading to the inert gas chamber to allow discharging the air contained in the bottle.

The air and wine tubes of each spout are actuated respectively by two controlling devices, each of which includes a small spring-loaded piston acting as a true shut-off tap. The pair of small pistons is actuated by the alternating motion of lever fitted with a handle, pressing its two elbows against a bracket which acts, in the lower part of the tap, on the actuating heads of the two small pistons.

The opening of the latter occurs at two separate instants: an air vent opens up first, allowing an instantaneous balancing of the pressure between the gas chamber and the interior of the still empty bottle, thus starting the flow of the wine filling the bottle. Other vacuum-filling machines are known for handling many types of foodstuffs, such as wines, liquors, sirups, fruit-juices, oils and liquid chemicals, shampoos, and cosmetic preparations. These machines work under a slight depression, thus creating a more or less pronounced vacuum in the container aspirating the product, which moves from the main source to the machine tank mounted above the filling section; the liquid volume in the tank is regulated by a float or by appropriate probes.

The containers are lifted toward the filling nozzles on cam-actuated tables and made to tightly fit against the rubber rings of the nozzles. The inside air is gradually expelled as the vacuum is applied; this achieves a substantial seal at the entrance tap, thus preventing any spillage in the surrounding environment; if a container is defective and cannot withstand the vacuum, it cannot be filled and is therefore automatically discarded.

Another type of traditional filling machine is the so-called volumetric or gravity machine, in which the filling occurs by free falling and constant dosing. The product is aspirated from the vat above the machine, immersed in the dosing devices and fed to the containers by the latter.

The machine is equipped with a number of dosing devices, each constituted by a cylinder with an internal piston aspirating the desired quantity of product, whose volume is determined by the diameter of the cylinder and the length of the piston run.

In the isobaric and in the known vacuum-actuated machines, however, the liquid to be bottled flowing through the neck of the bottle comes, while only for a brief period, in the contact with the air contained therein; moreover, the insufflated inert gas crossing the same conduit as the flowing liquid before falling into the bottle mixes with the liquid itself, thus causing some evident oxidising problems and therefore a rapid alteration of the same liquid.

In particular, these negative consequences are extremely important where edible goods with a short conservation span, such as wine, tea, milk and the like are bottled. In this regard and to eliminate this shortcoming, some isobaric machines have been developed which allow for a separate air return from the liquid handled, and can be equipped with a separate tubing for insufflating inert gas to the bottle. However, even the use of these machines cannot eliminate the problem of the presence of a certain volume of oxygen in the neck of the bottle, which remains in contact with the upper layer of the liquid contained therein.

In order to perform the phases of pre-evacuating the air inside the bottles and insufflating inert gas through the neck, it was further proposed to utilise a dedicated tube, fitted on the outside of the filling apparatus and separated from the central liquid feeding tube.

This solution, while advantageous from the viewpoint of an actual absence of product contamination and/or oxidation, poses numerous problems associated with the installation of the machine and the encumbering of relatively wide working spaces.

Moreover, an embodiment of this type amounts to production and operating costs that should rather be minimized.

The use of gravity machines avoids the oxidising problems mentioned above, because the pressure differential existing between the bottle interior and the filling tube is not used to introduce the liquid to the bottle, and the air aspirating step is therefore eliminated. However, these machines do not allow a complete filling process, because they make it impossible to perform the pre-evacuating and/or gas insufflating phases across the neck of the bottle; these operations must in fact, if desired, necessarily be carried out by dedicated systems, with the ensuing production delays and relatively high production costs.

SUMMARY OF THE INVENTION

The purpose of this invention is to achieve a machine for the filling of containers, in particular of bottles, capable of eliminating the mentioned shortcomings or to indicate a machine for the filling of bottles equipped with an effective seal at the entrance tap and simultaneously capable of preventing any air contact with the liquid to be bottled.

Another purpose of this invention is to achieve a machine for the filling of containers, in particular of bottles, which should also be capable of performing the phases of pre-evacuating the air inside the bottles and insufflating inert gas through the neck of the same, so as to maintain a stationary fluid condition above the free liquid level.

A further purpose of this invention is to indicate an effective method for the filling containers, in particular of bottles, to be carried out on the machine, in accordance with this invention.

A further purpose of the invention is to achieve a machine for the filling of bottles based on an easy and inexpensive construction, without a need to employ complex technologies or relatively costly components in relation to the advantages obtained.

According to the present invention, these purposes are attained by a machine for the filling of containers, in particular for the filling of bottles and the relative filling method, according to the claims 1 and 15, respectively, to be referred to for brevity.

Advantageously, the machine of the present invention is in every respect constituted by a traditional machine operating at a slight depression, with all the resulting benefits, such as a perfect seal at the liquid dispensing tap, combined with the added advantages of a vacuum-operated machine, such as the low absorption of oxygen by the bottled liquid, and simultaneously with those typical of an isobaric machine. Moreover, the same machine is capable of performing the phases of pre-evacuating air from the bottles and insufflating inert gas through the necks of the same, in addition to the normal operations of filling and releasing the residual liquid.

This doubling-up of the phases within the same machine is achieved by utilizing a cam endowed with a continuously rotating motion and a particular profile, coupled with an actuating piston conferring it a variable motion.

An actuating piston transmits an alternating motion to the bottle moving in the direction of the filling path, toward the tap or opposite to it, depending on the machine operating system.

The profiled cam is further connected to a second cam commanding a valve, positioned above the filling section, which can be commuted to three different positions corresponding to the phases of insufflating inert gas into the bottle, operating under a slight depression and operating under a vacuum.

The latter case allows performing a forced filling step in the presence of a powerful vacuum in the bottle, so as to attain better performances from the viewpoint of production speed and filled product purity.

However, such an operation can be performed only if the handled fluid does not foam during the mixing stage. The forced filling of the containers can therefore be carried out by water, but not, for instance, if the filling must be done with wine. Further characteristics and advantages of a machine for the filling of containers, in particular of bottles and the relative method of filling in accordance with the present invention, will become more evident from the following description and from the accompanying schematic drawings which show a non limiting embodiment of the invention.

FIGS. from 11 to 21 schematically represent partial sectional views of a machine for the filling of containers, in particular of bottles, according to the present invention; in various phases of a filling process.

DESCRIPTION OF THE PREFERRED EMBODIMENTS

Figure 1:
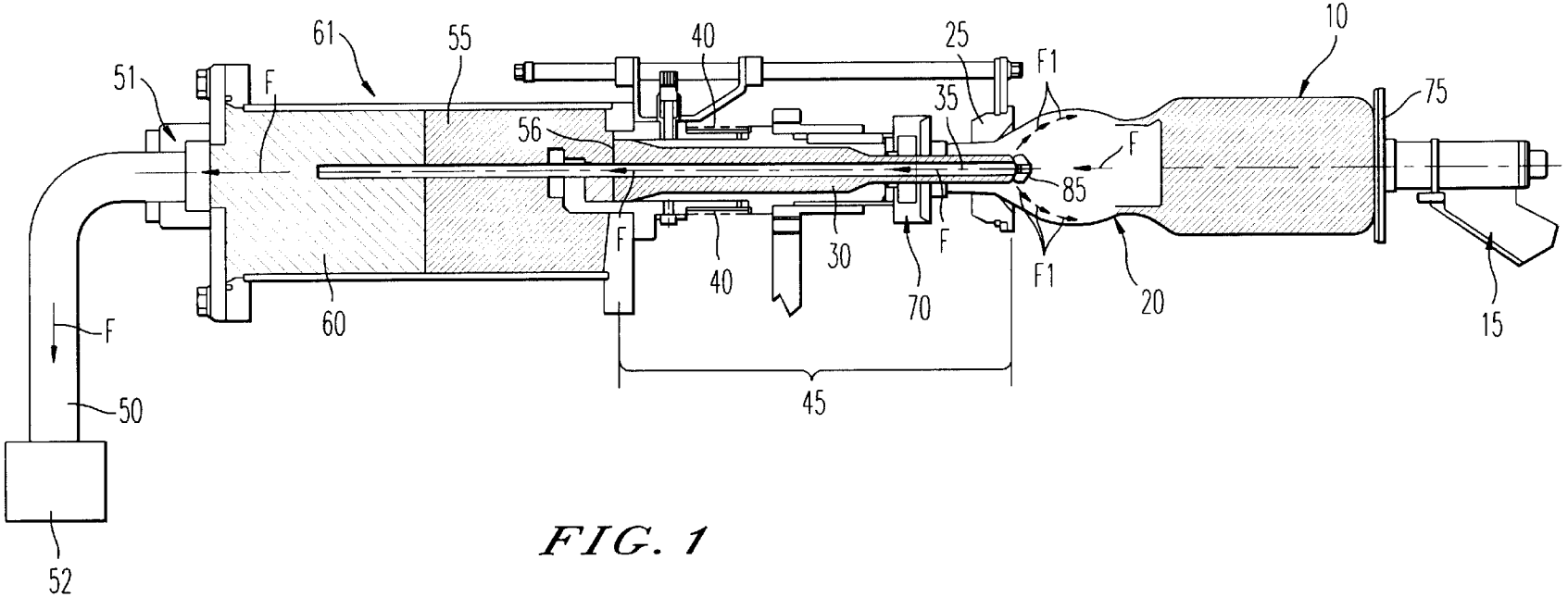
FIG. 1 schematically represents a partial sectional view of a traditional filling machine, of a type working under a slight depression or by gravity.
Figure 2:
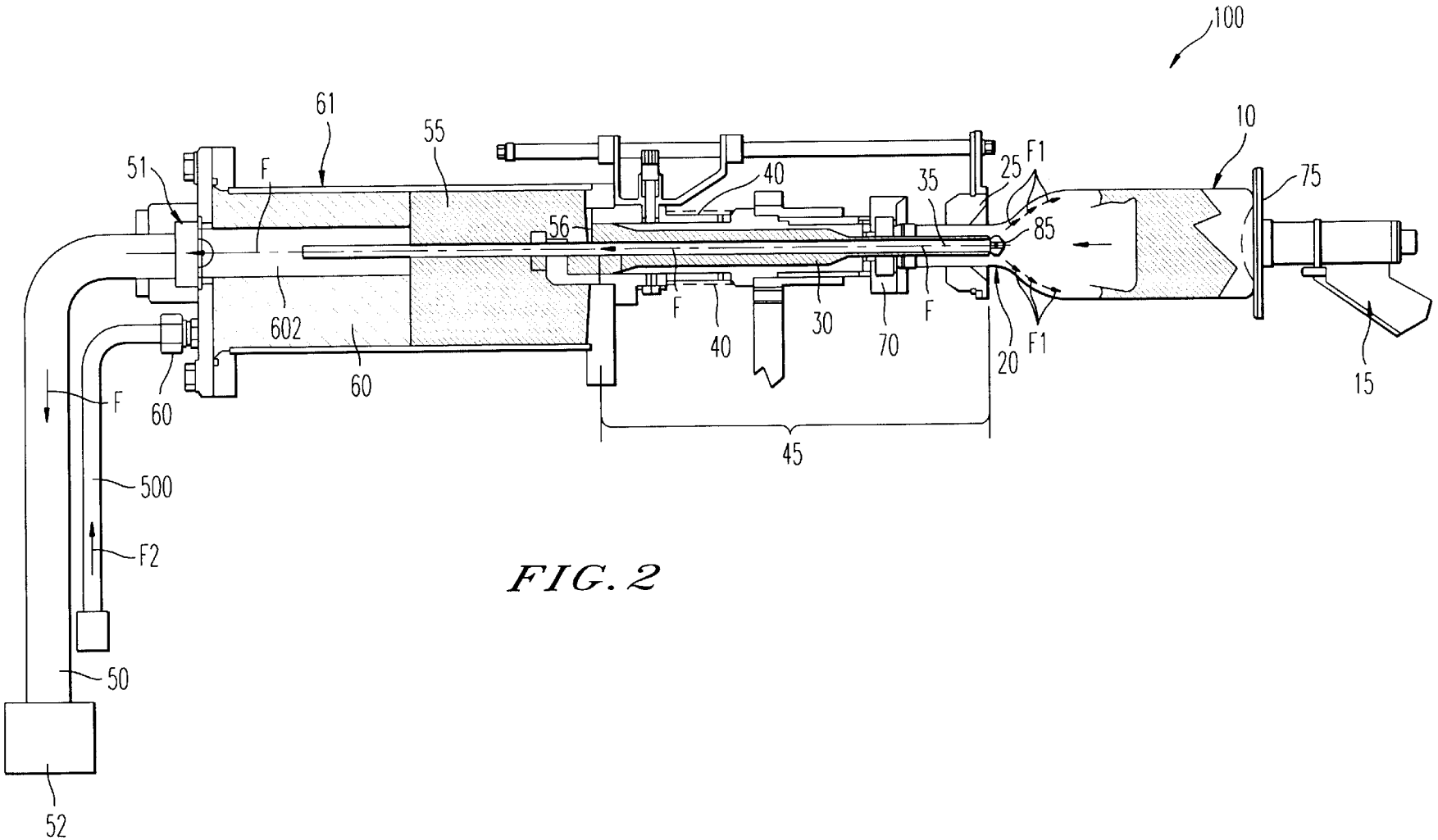
FIG. 2 schematically shows a partial sectional view of a traditional filling machine of a type working under a slight depression or by gravity, equipped with an returning tube for the air separated from the filling liquid.
Figure 10:
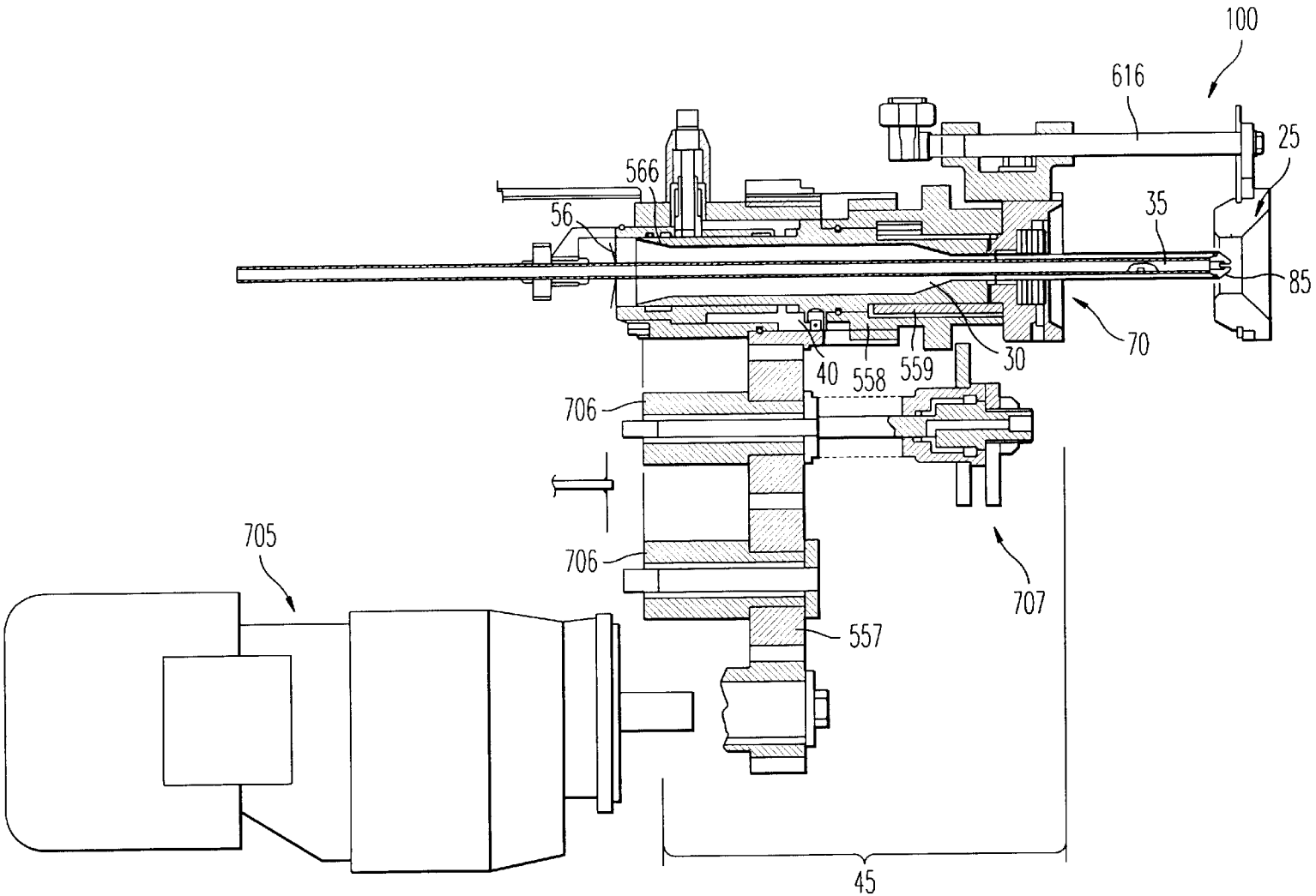

With reference to FIGS. 1 and 2, 10 generally indicates the container in which the liquid is introduced, being drained from a nozzle 85 of a filling section 45 of a filling machine 100; in a preferred but non limiting embodiment of the present invention, the machine 100 is suitable for bottles 10 destined for foodstuffs, such as water, wine, tea, milk, sirups, fruit juices and the like.

The machine according to the invention can also advantageously be used for filling the bottles 10 with liquid products in general, even if not of the food type, provided they are free of gases.

The nozzle 85 is fitted at the lower end of a spout comprising two concentric tubes indicated by 30 and 35, respectively, into which the liquid to be introduced to the container 10 and the air escaping from the container 10 to the outside flow in opposite directions. The air is aspirated from the container 10 by a vacuum pump schematically shown by 52, connected by a tubing 50 and a fitting 51 to a chamber 60 of a reservoir 61 receiving the tube 35. The tank 61 includes an area 55 for collecting liquid mounted opposite to the tube 30, at a certain height 56.

It should be noted that the path of the air aspirated through the neck 20 of the bottle 10 is indicated by the arrows F, while the path of the liquid to be introduced to the bottle 10 by the action of a tap 70 from the filling section 45 of the machine 100, is shown by the arrows F1.

The bottle 10 is pushed toward the filling nozzle 85 set on a table or plate 75 actuated by a transmission system 15 and made to tightly adhere to a centering cone 25, so as to gradually expel the air contained therein as the vacuum is applied along the tube 35.

The tube 30 is shifted, together with the body of the bottle 10, by the push of the table or plate 75, while the spring 40 is used to keep the tap 70 closed; moreover, the tap 70 comprises a tightly sealing rubber ring, which seats on the neck 20 of the bottle 10 during the filling phase.

In particular, FIG. 2 shows under no. 602 a chamber inside the tank 61, connected to the fitting 51 of the vacuum pump 52, which receives the upper end of the tube 35; this embodiment allows to keep the air, picked up from the neck 20 of the battle 10, separated from the inert gas contained in the chamber 600 of the same reservoir 61, so as to prevent the oxidation of the liquid contained in the bottle 10.

521 schematically indicates a pump for insufflating inert gas, 500 a tube for introducing inert gas to the machine 100, and 601 a venting valve for the inert gas, while the arrow F2 indicates the path followed by the gas within the machine 100.

Figure 3:
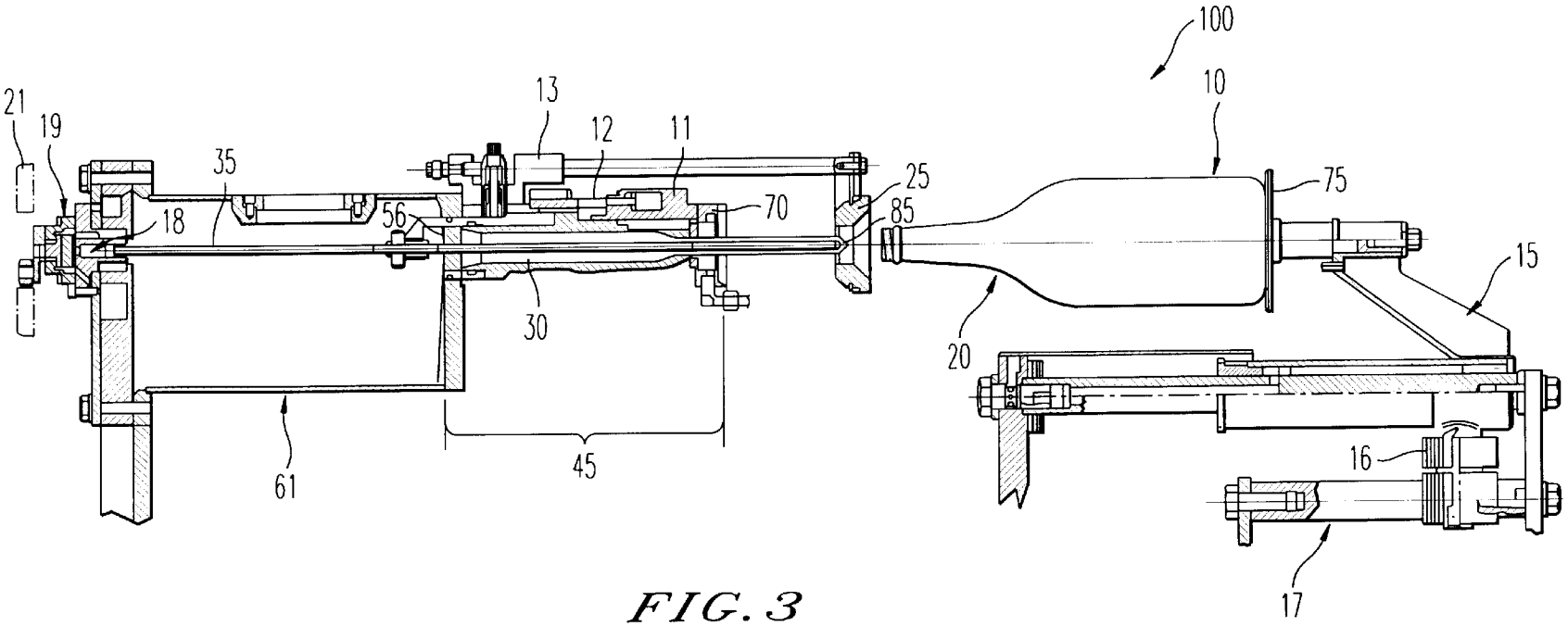
FIG. 3 schematically represents a partial sectional view of a first embodiment of a machine for the filling of containers, in particular bottles, according to the present invention.
Figure 4:
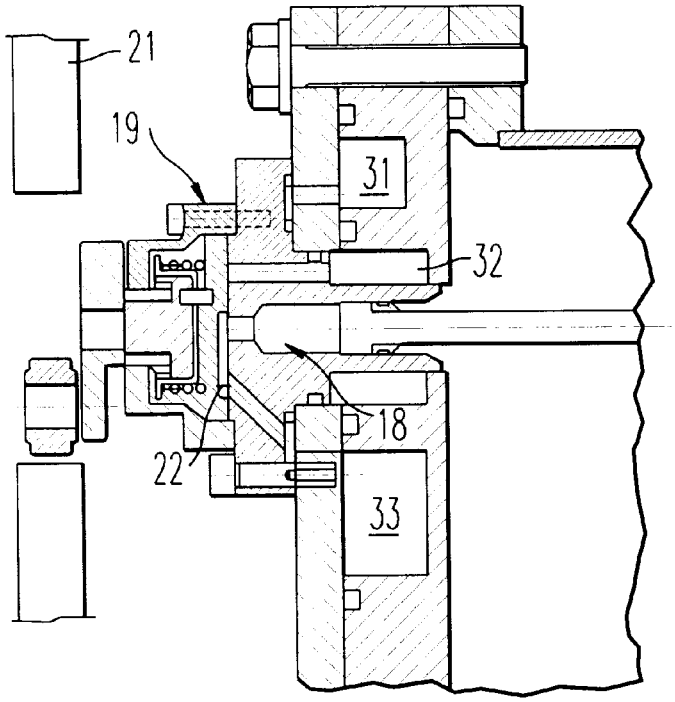
FIGS. 4 and 5 represent two enlarged details of the FIG. 3, respectively.
Figure 5:
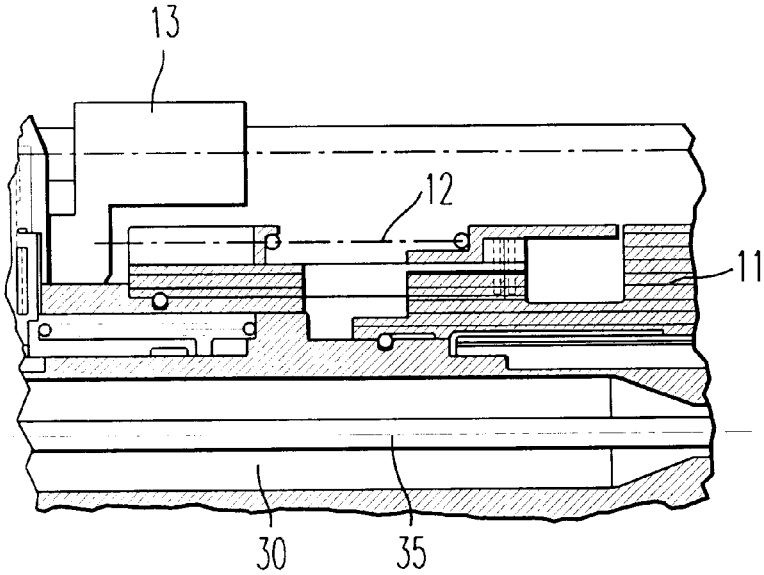

FIG. 3 shows the same elements present in the FIGS. 1 and 2 by the same reference numbers; moreover, 17 indicates a first cam engaging with the wheel 16 of a piston actuating the system 15, which in turn transmits the rotating motion of the cam 17 to the table or plate 75 supporting the bottle 10. Therefore, the table 75 moves in an alternating manner, so as to appropriately advance or retrieve the neck 20 of the bottle 10 from the filling section 45 and the centering cone 25, depending on the different positions assumed by the cam 17.

Moreover, the filling section 45 includes a cursor 11 rigidly connected to the filling tap 70 and connected by a precharged spring 12 to a bracket 13, which carries the centering cone 25 of the bottle 10, within which the nozzle 85 of the tube 30 is allowed to slide.

The tap 70 is connected to the cam 17, so that the entrance of the liquid into the bottle 10 is governed by the rotation of the cam 17, which can assume various operating positions.

The ending 18 of the tube 35 receiving the air drawn from the bottle 10 crosses the tank 61 and arrives at the valve 19, which can be commuted between three different positions of the machine 100, thanks to a second cam 21 mechanically or electro-mechanically connected to the same cam 17, which transmits the motion to a connecting eyelet 22. The latter connects the end 18 of the tube 35 alternatively to a first chamber 31 filled with inert gas, to a second chamber 32 at a slight depression, and to a third chamber 33 under a high vacuum.

The connection between the ending 18 of the tube 35 and each chamber 31, 32, and 33 occurs by changing the position of the eyelet 22, which has one ending attached to the tube 22 opposite to the ending 18 and the other moving, under the action of the cam 21, along a circular arc of about 90 degrees; the eyelet 22 crosses an arc of about 45 degrees to commute between one position and the other.

Figure 6:
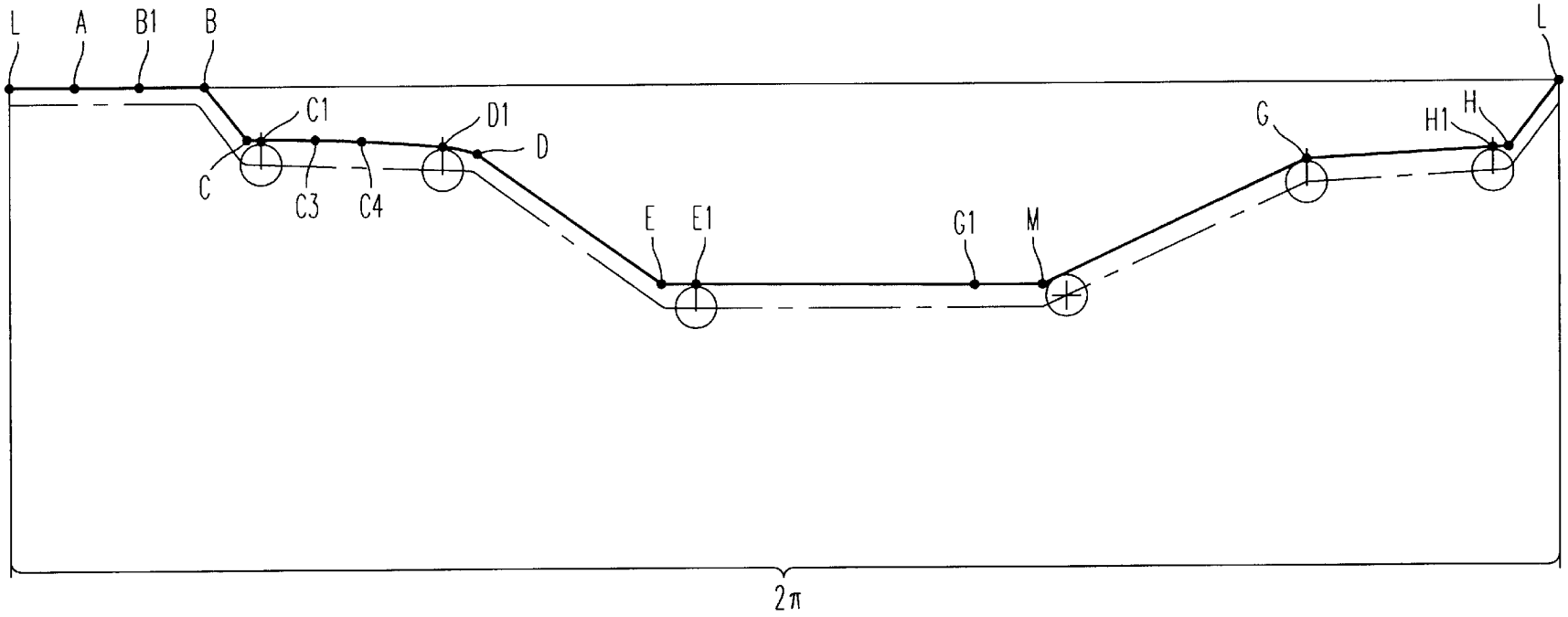
FIG. 6 represents the schematic geometric profile of a cam utilized in the machine shown in FIG. 3, according to the present invention.

The particular geometric profile of the cam 17 allows to separate the operating phases relating to the motion of the bottle 10 and the commuting action of the valve 19. The FIG. 6 schematically reproduces the geometric profile of the cam 17 controlling the table 75 to move the bottle 10.

The E-M portion of the profile controls the entering of the bottles into the filling section 45 of the machine 100, while the time interval corresponding to the profile portion E1-G1 run by the cam 17 governs the commuting action of the valve 19 to a position in which the tube 35 connects to the chamber 32 operating under a slight depression.

The profile portion E-D commands the slow and gradual motion of the bottle 10, as it approaches the rubber sealing ring of the tap 70.

The portion C-D takes care of a complete contact sealing of the rubber ring mentioned above, while holding the tap 70 in a closed position; during this time interval, the cam 21 controls in succession the commuting phase of the valve 19 to a position aspirating the gas present in the bottle 10 (pre-evacuating phase, during a time interval corresponding to the portion D1-C4 of the geometric profile run by the cam 17), the inert gas inflating phase in the bottle 10, corresponding to the portion C3-C4 of the profile (when the eyelet 22 connects the chamber 31 to the tube 35, thus allowing a quick commuting action of the valve 19), and the commuting action of the valve 19 working under a slight depression, corresponding to the portion C1-C3 of the profile (when the eyelet 22 connects the tube 35 to the chamber 32), so as to allow the operation of filling the bottle 10. The phases of pre-evacuating the gas contained in the bottle 10 and of injecting the inert gas are repeatable, depending on the user's requirements.

The portion B-C of the geometric profile of the cam 17 governs the quick opening action of the tap 70 for the filling step, while the portion B-L of the profile of the cam 17 relates to the filling phase of the bottle 10.

It is eventually also possible to perform a forced feeding operation of the bottles 10, during a time interval corresponding to the portion A-B1 of the profile of the cam 17; before this operation, the cam 21 commands the quick commutation of the valve 19 to the position in which the tube 35 connects to the high vacuum chamber 33, so as to generate a high vacuum in the bottle 10. The optional operation of a forced introduction of liquid into the bottle 10, under high vacuum conditions, allows a better performance of the plant, despite the fact that it can be effected only if the filling liquid is water.

The portion H-L of the cam commands, after the filling, the quick closing of the tap 70, while the portion H1-G controls the motion of the bottle 10 on the rubber ring of the tap 70, which achieves a tight sealing contact thanks to the reaction of the spring 12. In this phase, the filling liquid rises in the tube 30, while the valve 19 commutes so as to insufflate inert gas into the bottle 10. The residual liquid in the tube 30 is at this point released and drops back into the neck 20 of the bottle 10.

The G-M portion of the profile controls the motion of the bottle 10, commanded by the spring 12, during its return and the slow removal motion from the sealing ring, after the filling operation has been completed.

During this time interval the valve 19 commutes and the eyelet 22 connects the tube 35 with the chamber 31 to enable it to insufflate inert gas into the neck 20 of the bottle 10, which is slowly removed from the section 45.

In this manner, the tube 35 can very slowly withdraw from the neck 20, so as to maintain the inert gas in the neck 20 of the bottle 10 in a very stationary condition, above the free surface of the liquid introduced. The procedure is ended by the capping phase of the bottle 10.

Finally, the particular structure of the machine 100, where the valve 19 is arranged opposite one of the endings and allows performing the operations of aspirating air from the bottle and/or of injecting the inert gas, allows a complete sanitizing action of the machine 100 itself, by acting only in the vicinity of the free ending 18 of the tube 35.

Figure 7:
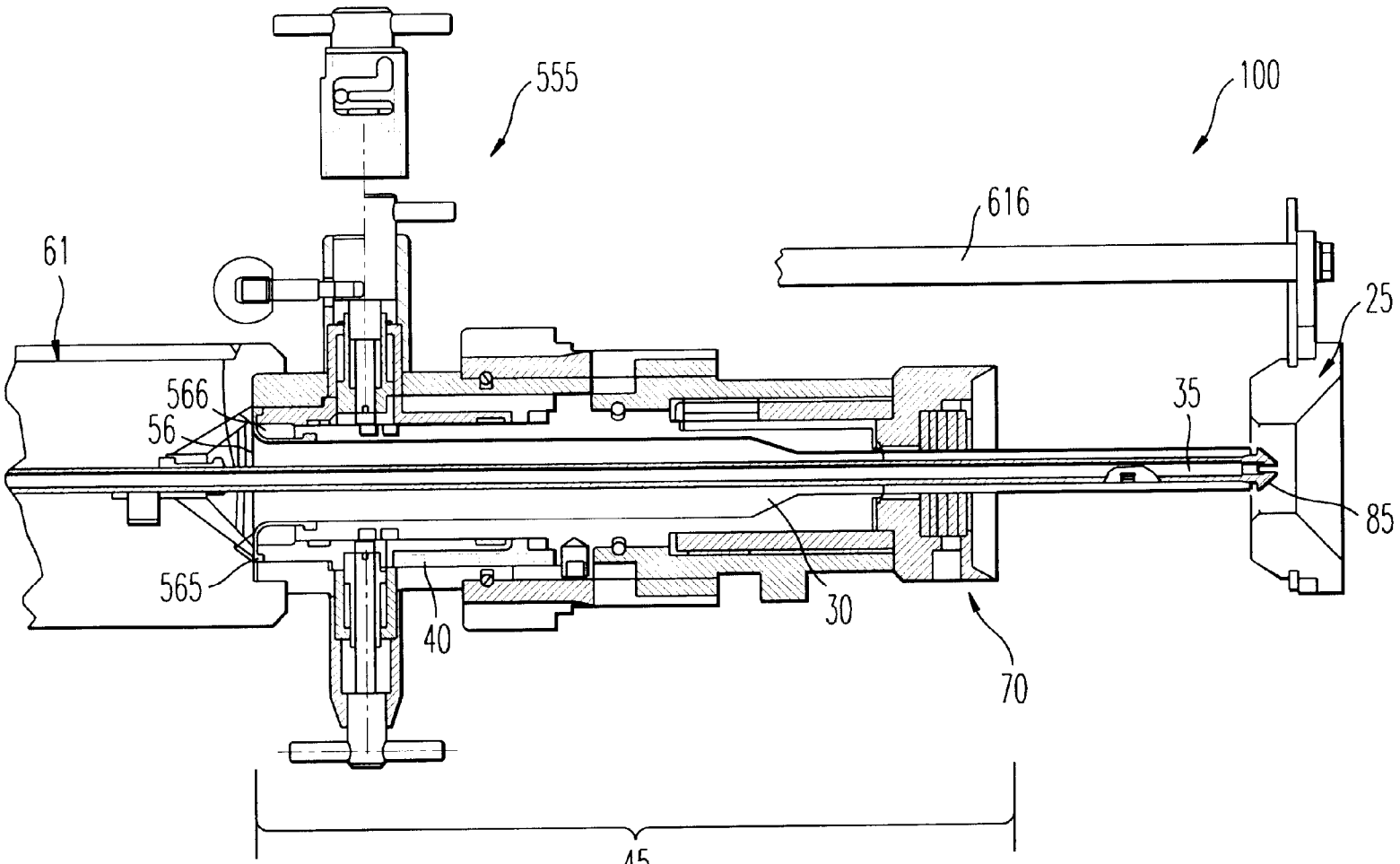
FIG. 7 schematically represents a partial sectional view of a second embodiment of a machine for the filling of containers, in particular of bottles, according to the present invention.
Figure 8:
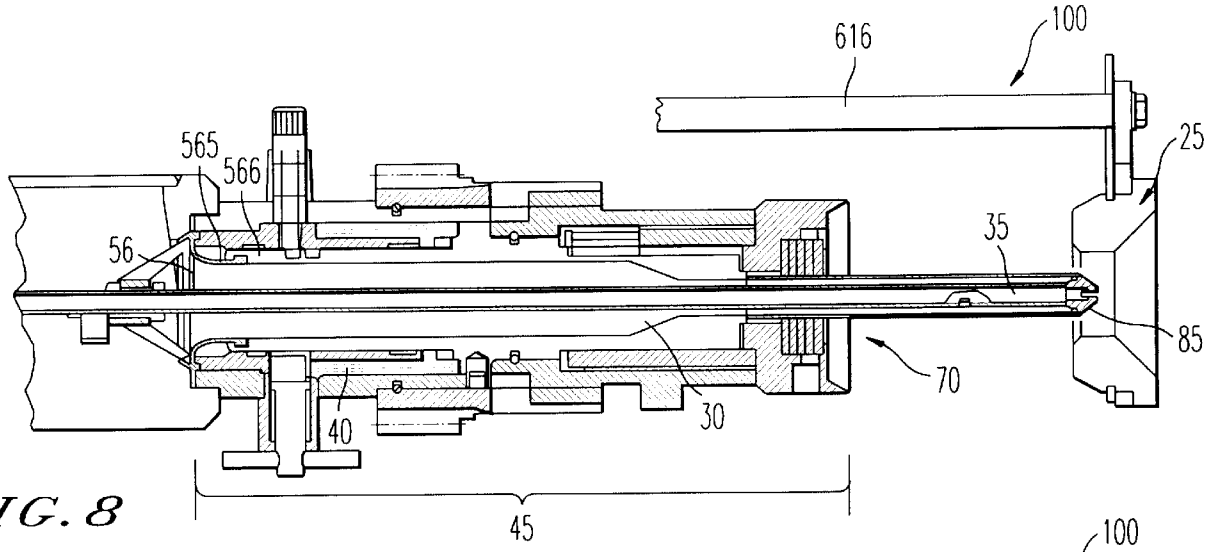
FIGS. 8, 9 and 10 schematically represent three partial sectional views of further embodiments of a machine for the filling of containers, in particular of bottles, according to the present invention.
Figure 9:
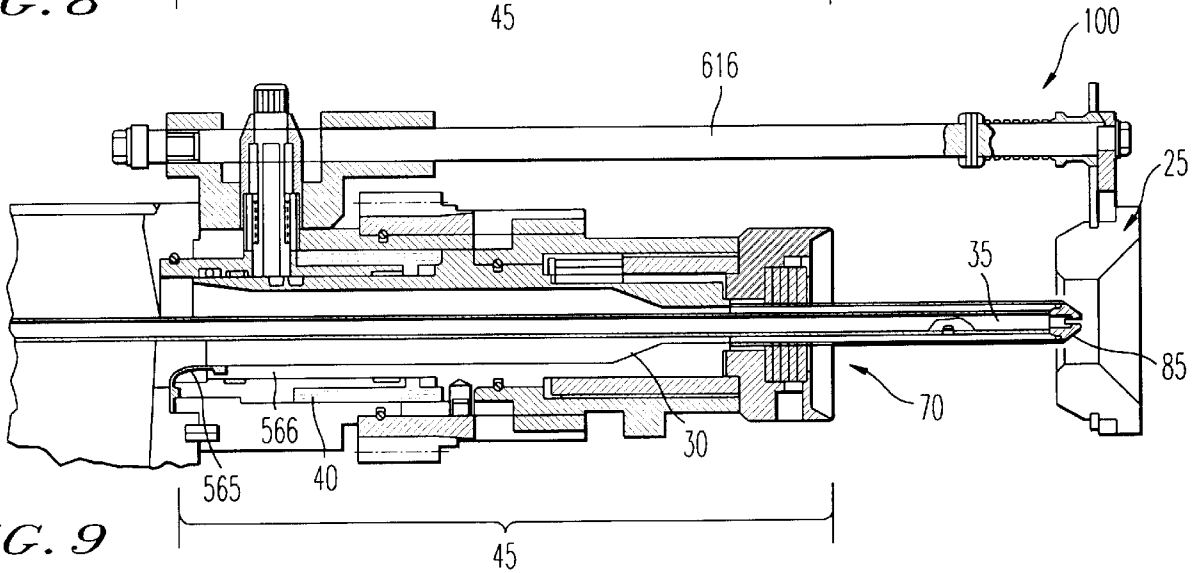

Alternative embodiments, as illustrated in particular in FIGS. 7, 8 and 9, envision the use of a membrane gasket indicated by 565, connected on one side to the upper end of the tube 30 next to the level 56, and on the other side to the fixed body 566 of the tap 70, for the purpose of guaranteeing a seal at the upper parts of the tube 30 during the filling and/or sanitizing steps.

The gasket 565 allows to achieve an effectively tight seal with respect to both the tank 61 and the mobile elements fitted inside the tap 70, during the filling operations.

In order to improve the working action of the gasket 565 and therefore ensure an extra sealing action at various points of the machine 100, an eccentric element 555 is preferably used, connected to the fixed body 566 of the tap 70; the application of a pressure on the eccentric element 555 produces an increased sealing action between the mobile elements arranged in the machine 100, while rotating the eccentric element 555 produces a shifting motion of the tap 70 toward the tank 61, with the resulting squashing of the gasket 565 against the tank 61 itself, so as to achieve an even more effective seal at the level 56.

Moreover, as schematically shown in particular by FIG. 9, the centering cones 25 may be mobile with respect to the tap 70, so as to ease the washing and sanitizing operations, while releasing the nozzle 85. This can be obtained by connecting each centering cone 25 to a mobile part 615 made of elastic materials and/or composed of pneumatic means, and of a supporting rod 616 arranged in a position parallel to the tubes 30 and 35. The supporting rod 616 may be attached to the machine 100 at the level 56 or opposite to the tap 70, as shown for example in FIG. 10.

According to the invention, the filling machine 100 finally allows to achieve, by a small variant, a self-leveling action of the bottle 10, even while operating under a slight depression or by gravity.

Figure 12:
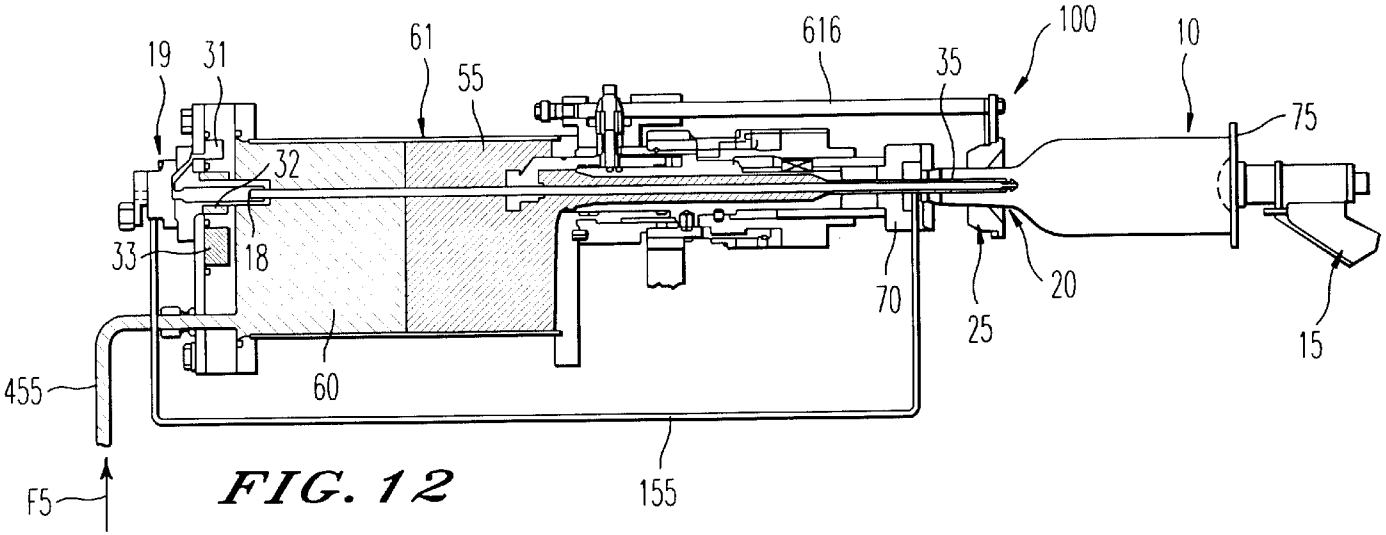
Figure 11:
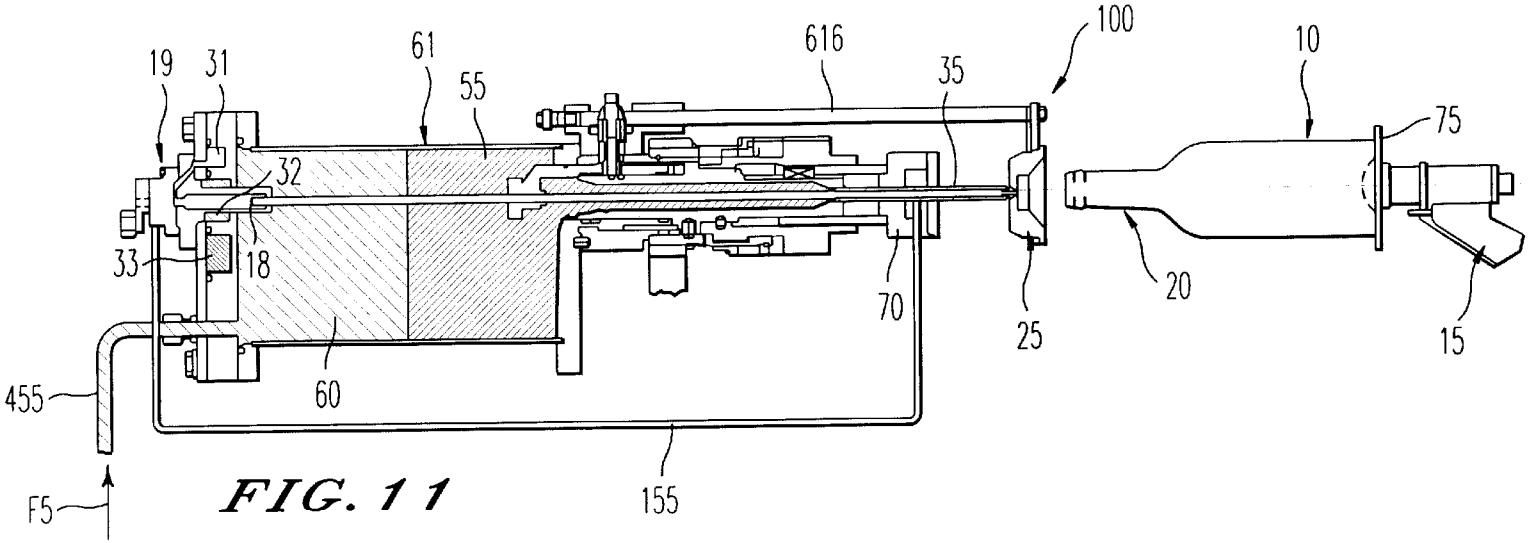
Figure 14:
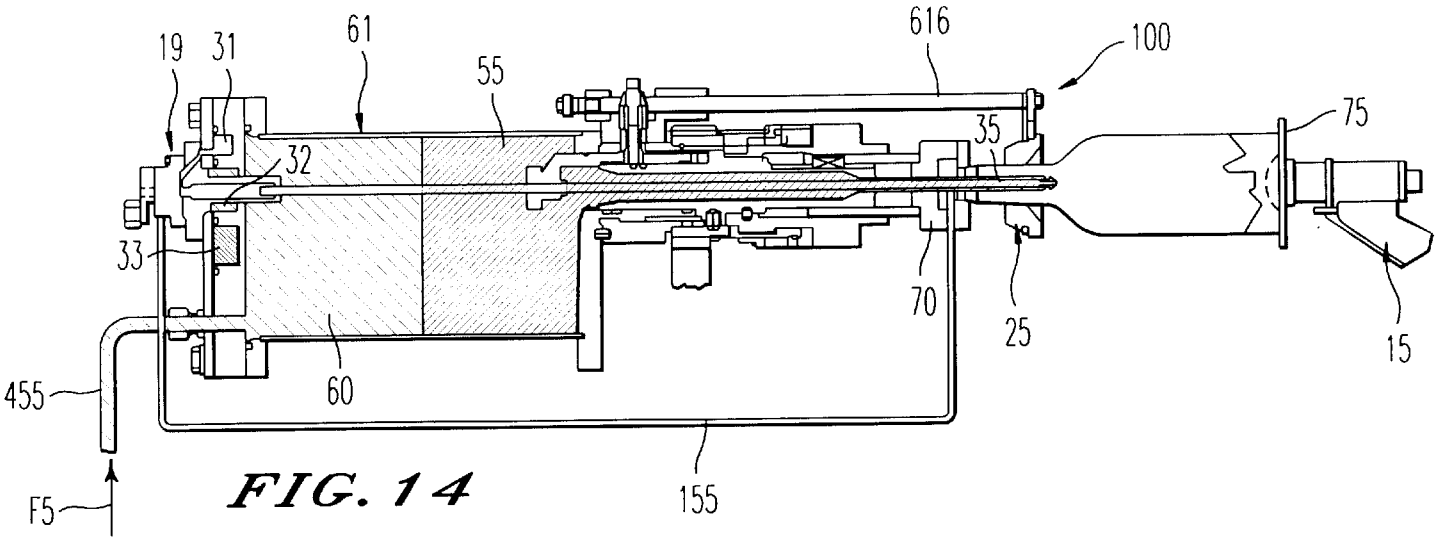
Figure 13:
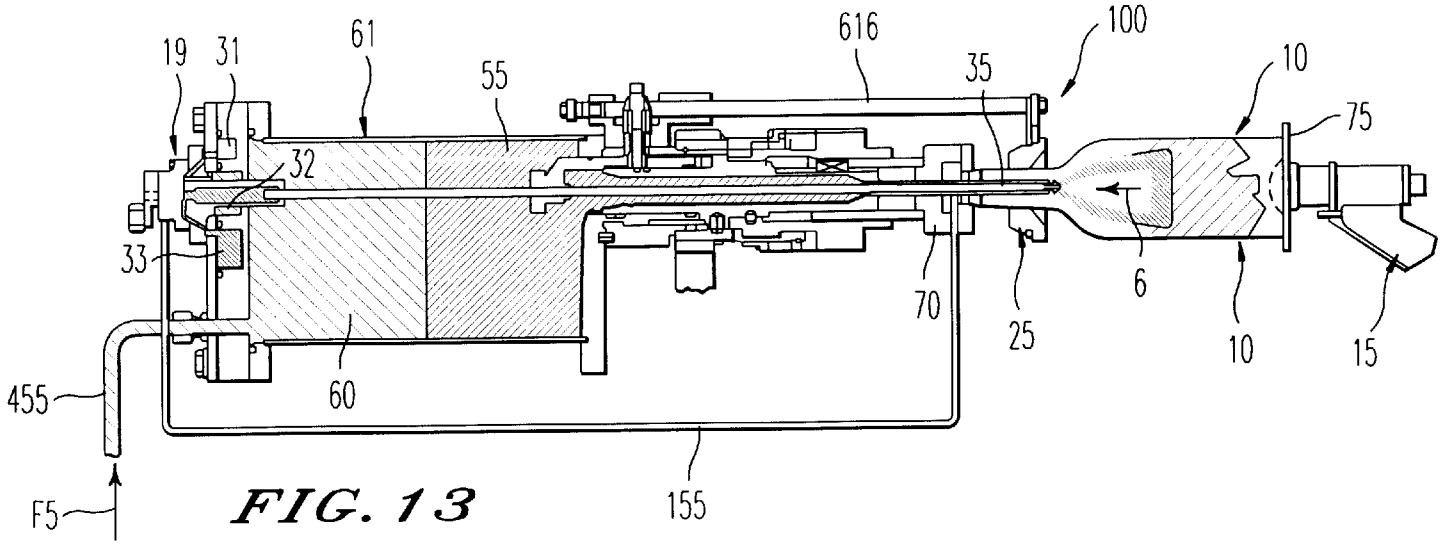

After having accomplished a tight seal between the bottle 10 and the tap 70 while simultaneously insufflating inert gas into the chamber 60 of the tank 61 along the conduit 455 in accordance with the direction of the arrow F5 in the FIGS. 11 and 12, it is in fact possible to perform the operations of pre-evacuating the air from inside the bottle 10 across the tube 35, according to the direction of the arrow F6 shown in FIG. 13, and of introducing inert gas according to the direction of the arrow F3 shown in FIG. 14, always from the tube 35, across the nozzle 85 and into the bottle 10.

Figure 16:
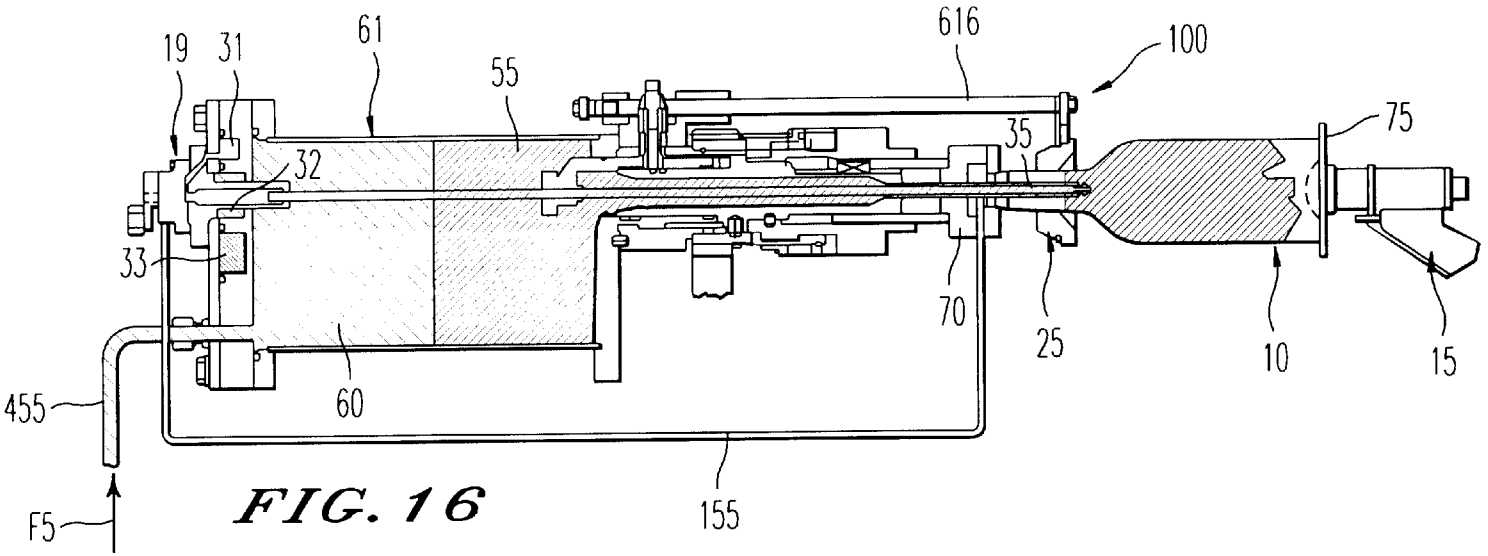
Figure 15:
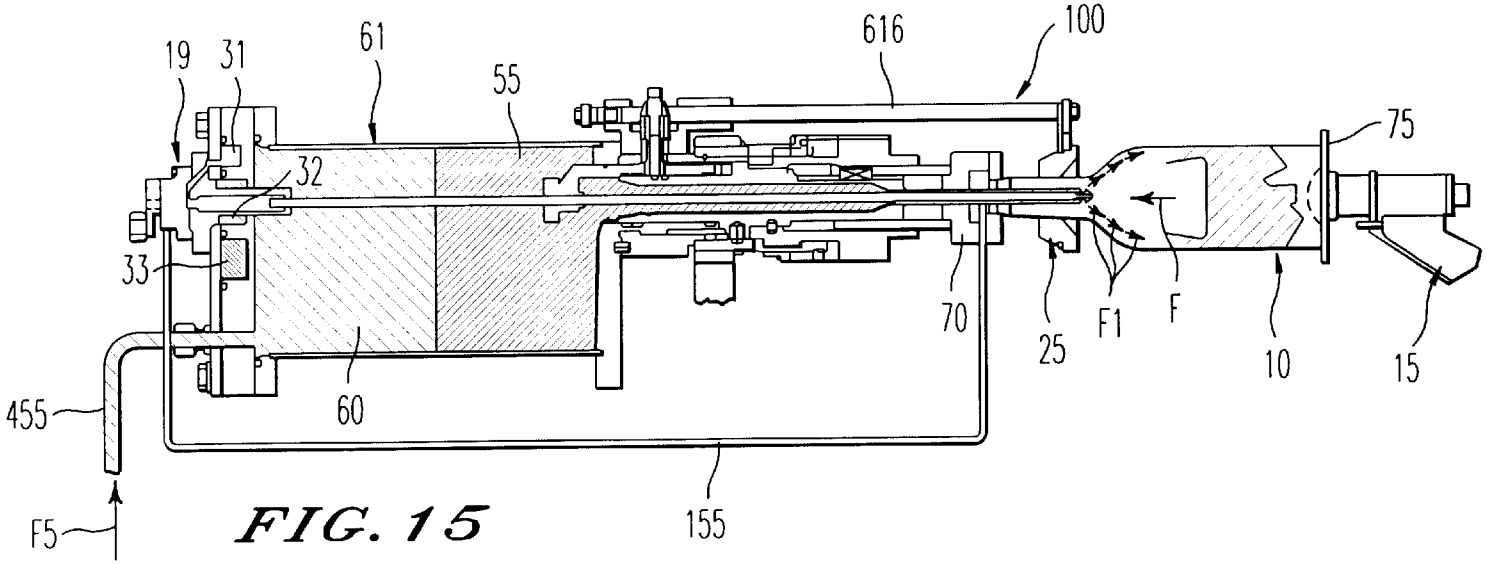
Figure 17:
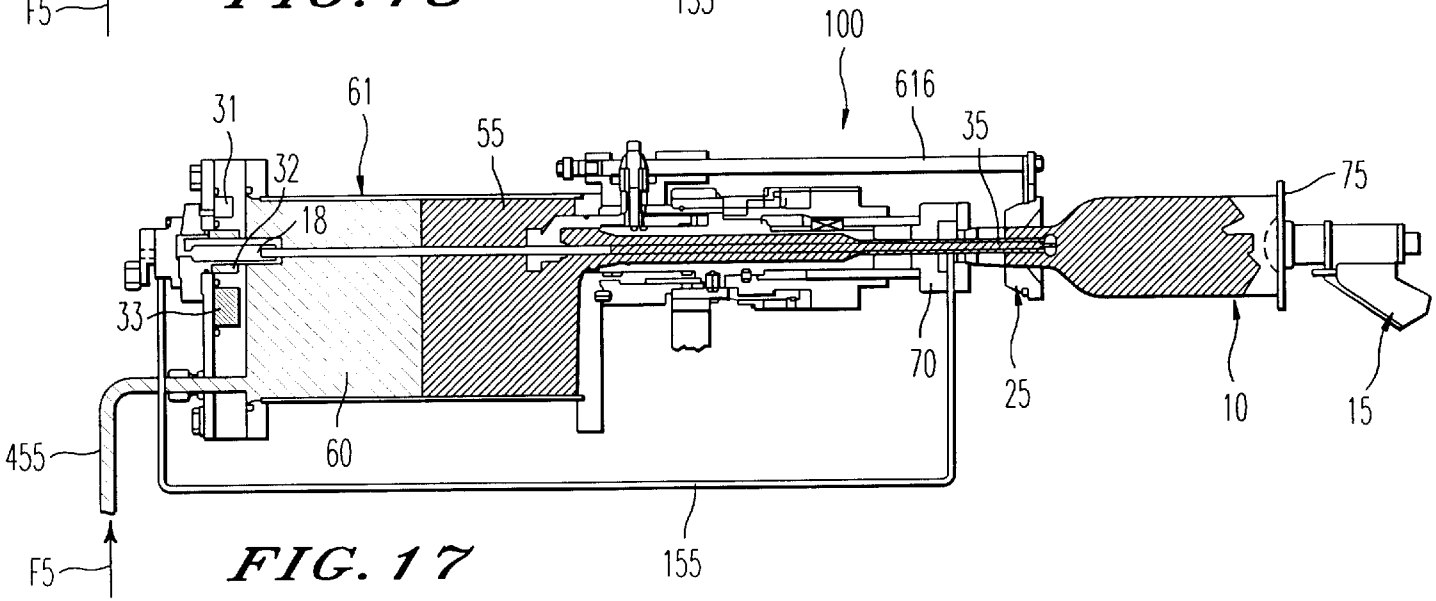

At the end of the phases of filling the bottles 10 and of closing the tap 70, as shown by the FIGS. 15, 16 and 17, respectively, which are accomplished by aspirating inert gas from the neck 20 of the bottle 10 according to the direction of the arrow F and consequently by inducing the falling of the liquid according to the direction of the arrows F1, the liquid level rising back up along the neck 20 of the bottle 10 is necessarily variable and therefore changes the filling level of each bottle 10. In order to prevent this inconvenience, the commuting action to open and close the valve 19 set into the tank 61, 705 or outside the same is usually programmed so as to manually or automatically block the exit of liquid from the nozzle 85 at the appropriate time, while taking into account that the liquid rises in the neck 20 of the bottle 10 because of the aspirating action of inert gas from its interior.

This method is however extremely costly in terms of the implementing time required, and above all poorly reliable.

Alternatively, according to this invention, the chamber 31 containing inert gas under pressure is connected by a tube 155 with the tap 70 directly in contact with the neck 20 of the bottle 10 (FIG. 18); this achieves a pressure differential at the neck 20 of the bottle 10.

Figure 18:
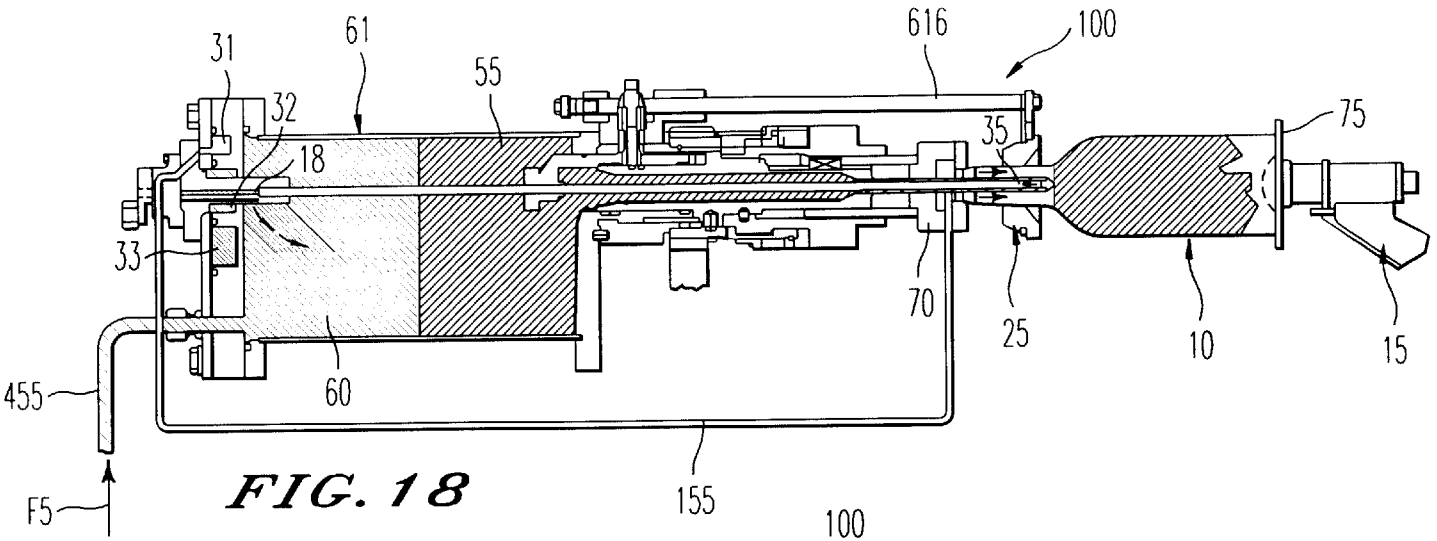

The resulting effect is that of achieving a precise liquid level in the bottle 10, with the possibility of aspirating all the excess liquid spilled from the neck 20 of the bottle 10, which rises along the tube 35 and exits from the free end 18; at this point, the excess liquid can again be introduced to the tank 61, as shown by the arrows F4 of the FIG. 18, or eliminated by causing it to exit from the tank 61, outside the filling machine 100.

If the liquid is reintroduced to the tank 61, it is possible to exploit the negative pressure differential of 0.5 bar existing in its interior, so as to obtain a total differential pressure of about one bar between the level corresponding to the tap 70 and the level of the liquid outlet from the tank 61.

Figure 19:
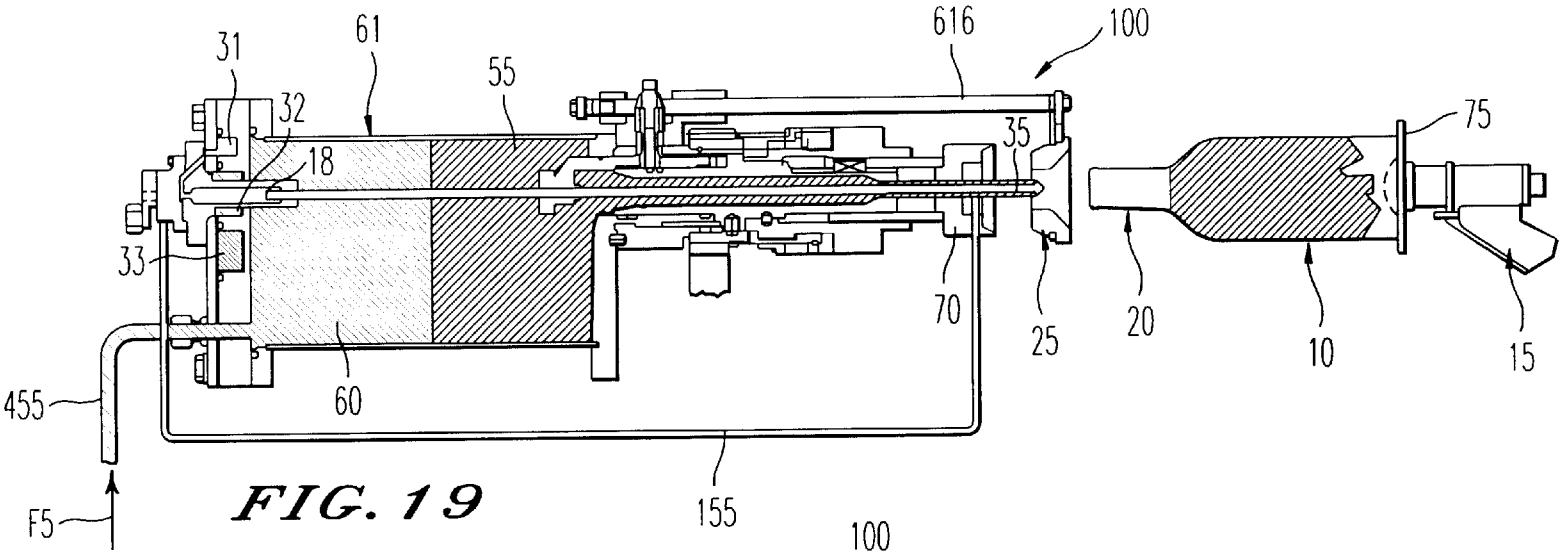
Figure 20:
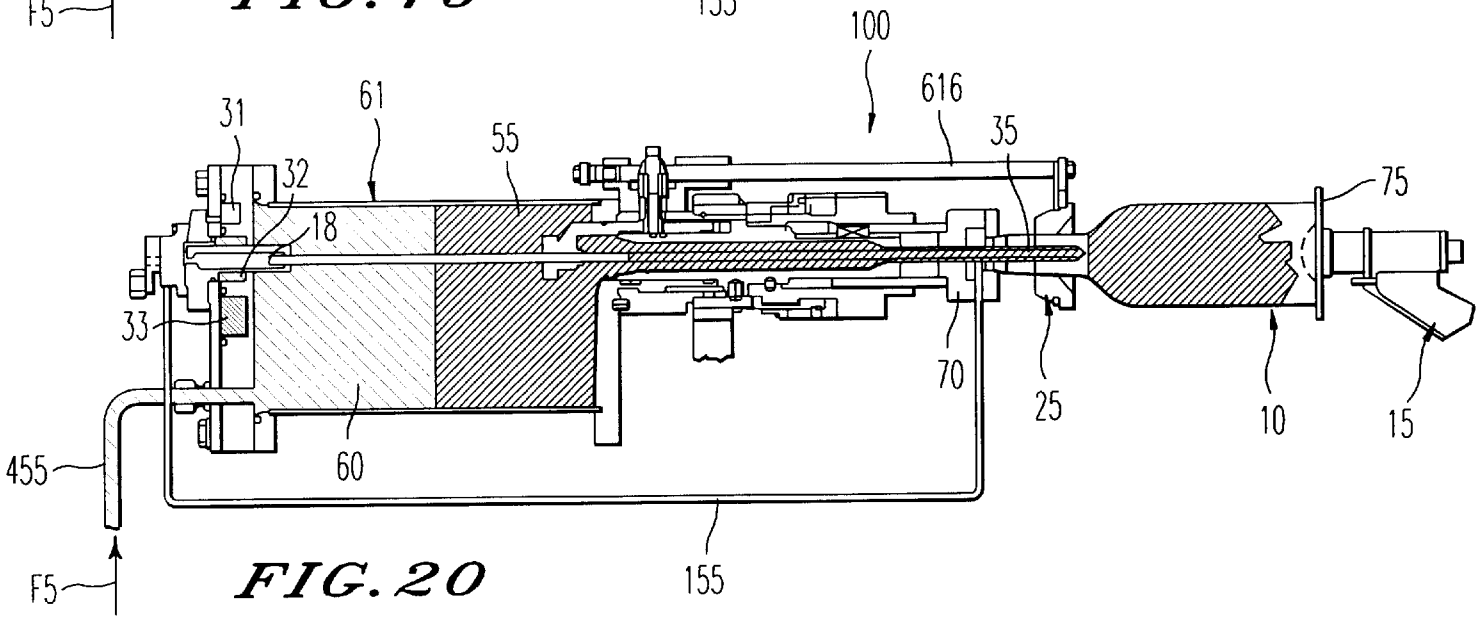
Figure 21:
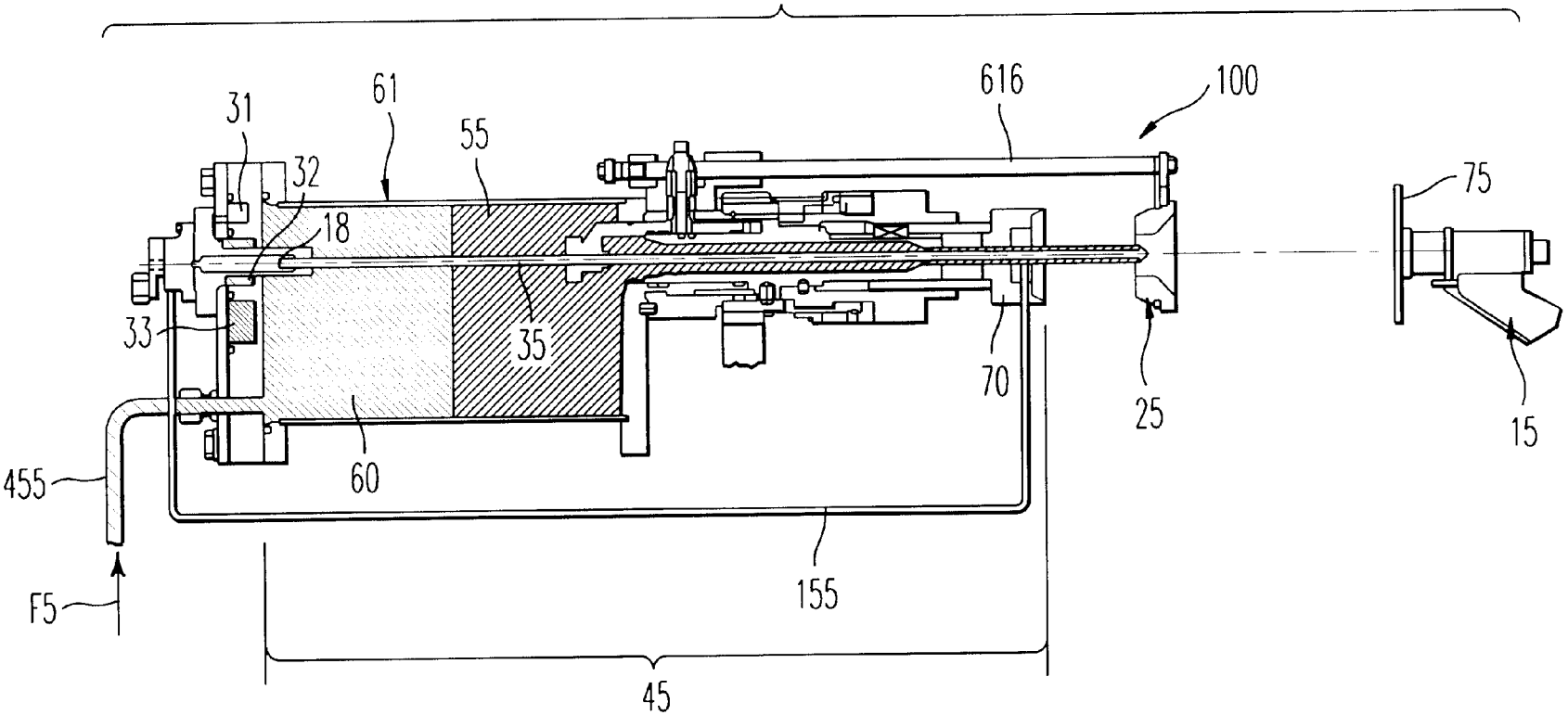

Finally, even in this case the procedure of filling the bottle 10 ends with the slowly insufflating phase of inert gas from the nozzle 85 inside the neck 20 of the bottle 10, simultaneously with the phase of withdrawing the neck 20 of the bottle 10 from the tap 70 by actuating the system 15 which moves the plate 75; reference to FIGS. 19, 20 and 21 should be made in this regard.

The adjustment of the liquid level in the bottle 10 may also be simultaneously effected on all the taps 70 of a filling machine 100, thanks to a single electric actuator 705, capable of rotating a common sprocket 557 which transmits the motion to the threaded elements 558 and 559 of the taps 70, suitable for a vertical shifting of the same (FIG. 10).

The adjusting process is run by an electronic programming and controlling system, which processes the data relating to the portion of the tube 35 introduced into the neck 20 of the bottles 10 and of the vertical shifting of the tap 70 with respect to a reference level and the volume of liquid which rises up the tube 35 itself and consequently commands the flow of liquid from the nozzle 85 and the relative motions of the tap 70.

Attention is drawn to the fact that, as schematically shown by the FIG. 10, between one tap 70 and another of a filling machine 100, a crown of free wheeling sprockets 706 is provided, which can be engaged by a series of gears, mounted on pneumatic devices 707, which allow the automatic opening of all the taps 70 connected to a machine 100, so as to carry out the usual sanitizing operations, consisting in an accurate washing of the internal parts of the machine 100 in contact with the liquid to be bottled, while keeping the tap 70 open and in a freely draining position. In this case, the sanitizing operation can be carried out directly at the tap 70, even without the centering cones 25.

The description given clearly outlines the characteristics of the machine for the filling of containers, in particular of bottles and the relative filling method which are the object of this invention, as well as its resulting advantages. These concern the following aspects in particular:

- an absence of oxidation of the liquid contained in the bottle;
- an effective seals at the neck of the bottle during the filling phase;
- a possibility of performing the phases for pre-evacuating the air in the bottle and insufflating inert gas into the neck while preventing the contamination of the liquid with oxides;
- a complete sanitizing of the machine by acting on a limited portion of the same.

It is obvious that numerous variants may be applied to the machine for the filling of bottles and its method of filling, which are the object of this invention, without abandoning the principles of novelty embodied by the inventive concept. The materials, shapes and sizes of the illustrated details may be of any type depending on the requirements, and the same may be substituted by other technical equivalents.

What is claimed is:

1. A machine for the filling of containers in particular for the filling of bottles comprising at least one container receiving a liquid drained from a nozzle of a filling section of said machine by opening a tap, said nozzle being arranged at one of the ends of a piping system comprising two concentric tubes respectively crossed in opposite directions by the flow of said liquid originating from at least one storage tank and of air aspirated from the outside portion of said container, which is moved in the direction of the falling liquid, by an actuating system comprising a table pushing against the bottom of said container and causing it to tightly adhere to a sealing ring of said tap, for the purpose of aspirating the air inside the container, said tubes being actuated by corresponding commanding devices for closing said tap, with said machine further providing a member for insufflating inert gas inside said container, wherein said actuating system is governed by a continuous rotating motion of a first cam having a contoured profile connected to the profile of at least one transmission member receiving a variable motion, depending on the various positions assumed by said first cam, said transmission member being connected to said table supporting said container in such a manner as to advance or retract said container from said filling section and said tap.

2. A machine according to claim 1, wherein said filling section comprises at least one cursor rigid with said filling tap and connected, by at least one pre-chargeable spring, to a bracket supporting a centering cone within which said tubes are sliding.

3. A machine according to claim 1, wherein said tap is connected to said first cam in such a manner that the flow of said liquid in said container is regulated by the rotation of said first cam.

4. A machine according to claim 1, wherein at least one end of said tube receiving said air drawn from said container is connected to at least one valve commutable between a plurality of different operating positions, by a second cam mechanically or electro-mechanically connected to said first cam.

5. A machine according to claim 4, wherein said second cam transmits its motion to at least one connecting eyelet which brings said first ending of said tube receiving the air into contact with a first chamber filled with inert gas, a second chamber under a slight depression and a third chamber under a high vacuum.

6. A machine according to claim 5, wherein the connection between said ending of said tube receiving said air and each of said chambers occurs by changing the position of said eyelet, which presents one ending fixed to said tube and another mobile end, whose motion, governed by the motion of said second cam occurs in a rotating manner along a circular arc of at least 20 degrees.

7. A machine according to claim 6, wherein said connecting eyelet is moveable over an angle of at least 20 degrees.

8. A method of filling of a container to be implemented on a filling machine according to claim 5, which comprises:

positioning said container in correspondence with a filling section of the machine;

commuting said valve to a position in which said tube receiving air is connected to said second chamber under a slight depression;

moving said container gradually toward said tap for feeding liquid, by using said actuating system commanded by said first cam moving said table or plate;

establishing contact between at least one ending of said container and said tap sealing ring up to the point of attaining a tight seal, said tap for liquid feeding being closed;

commuting said valve to an operating position in which said tube receiving air is connected to said third chamber under high vacuum;

insufflating inert gas inside said container, said valve rapidly commuting to an operating position in which said eyelet connects said tube receiving air to said first chamber;

commuting said valve to an operating position in which said eyelet connects said tube receiving air to said second chamber under a slight depression, for the purpose of carrying out the filling operation of said container, said tap being quickly opened by said first tube;

filling of said container, said valve quickly moving to an operating position in which said tube receiving air is connected to said third chamber under high vacuum, in order to achieve a high vacuum in the container, quickly closing of said tap by actuating said first cam, after the filling is completed, in such a manner that said filling liquid rises inside one of said tubes;

commuting said valve to an operating position in which said tube receiving air is connected said first chamber for the purpose of insufflating inert gas into said container;

releasing the residual liquid contained in one of said tubes inside said container;

removing said container, by actuating said spring from said liquid feeding tap, and consequently slowly draining of the liquid from said tube receiving air from said container, to maintain a stationary inert gas condition above said free liquid level.

9. A machine according to claim 4, wherein said valve is located in proximity with one of the endings of said machine to perform a complete sanitizing operation by acting on only a first ending of said tube receiving air.

10. A machine according to claim 9, wherein, said centering cone is connected to the mobile part of a supporting rod, arranged parallel to said tubes and fixed to said machine of said first ending of at least one of said tubes or of said tap.

11. A machine according to claim 1, wherein, at least one membrane-type gasket is applied to the sides of at least one of said tubes next to said first ending, to seal during at least one of the filling or sanitizing operations.

12. A machine according to claim 11, wherein said sanitizing operation is performed by automatically opening said tap with the aid of mechanical devices.

13. A machine according to claim 1, wherein, there is provided a mechanical sealing device of an eccentric type, connected to at least one fixed body of said machine.

14. A machine according to claim 1, wherein, said first chamber is brought in contact, by a tube, with said tap being in direct contact with the neck of said bottle.

15. A machine according to claim 1, wherein, an electrical actuator capable of rotating a sprocket to transmit motion to two mobile portions of said tap, to adjust the liquid level inside said bottle simultaneously on a plurality of taps.

* * * * *